US005664407A

United States Patent [19]

Cooper, III et al.

[11] Patent Number: 5,664,407

[45] Date of Patent: *Sep. 9, 1997

[54] PACKAGING MACHINE

[76] Inventors: Clayton C. Cooper, III, 16 Bittersweet La., Clifton Park, N.Y. 12065; David R. Gordon, 1145 Myron St., Schenectady, N.Y. 12309; William B. Drobish, 10 Hayes Pl., Amsterdam, N.Y. 12010

[ * ] Notice: The terminal 28 months of this patent has been disclaimed.

[21] Appl. No.: 62,342

[22] Filed: May 14, 1993

[51] Int. Cl.[6] ..... B65B 23/12; B65B 35/30

[52] U.S. Cl. ..... 53/542; 53/244; 53/251; 53/254; 53/534

[58] Field of Search ..... 53/542, 540, 531, 53/532, 254, 244, 251, 260, 255, 534

[56] References Cited

U.S. PATENT DOCUMENTS

| | | | |
|---|---|---|---|
| 3,655,180 | 4/1972 | Holler | 53/542 X |
| 3,766,706 | 10/1973 | Graham | 53/531 X |
| 3,822,528 | 7/1974 | Carlsson et al. | 53/542 |
| 4,162,870 | 7/1979 | Storm | 53/542 X |
| 4,921,398 | 5/1990 | Fluck | 53/532 X |
| 5,018,334 | 5/1991 | Guttinger et al. | 53/542 X |
| 5,081,823 | 1/1992 | van der Ent | 53/542 X |

*Primary Examiner*—James F. Coan

[57] ABSTRACT

A machine for packaging uniform-sized articles having generally flat, parallel sides and uniform length, width and thickness comprising the use of an array of articulating vanes attached in tandem and moved in a closed curvi-linear path. As the vane passes a loading station, each vane receives a single article upon a loading surface thereof. Each vane then carries such article to an unloading station (which may include means for packing said articles into boxes). During the aforesaid transit, the article is retained between adjacent vanes, side retainer and inner and outer retaining rods the latter rods operating together which operate together to strip the article toward and into a packing box.

10 Claims, 3 Drawing Sheets

PACKAGING MACHINE

BACKGROUND OF THE INVENTION

The present invention concerns a machine for receiving donuts or similarly shaped flat-sided articles and for automatically packaging a prescribed number of each donut or article in boxes for shipment. There have been various systems designed for handling various articles including donuts, for example, U.S. Pat. Nos. 3,766,706, 3,882,768, 4,162,870 and 4,921,398, but each of these fails to disclose the simplicity and fool-proof handling provided by the present invention.

SUMMARY OF THE INVENTION

In accordance with the present invention, a machine has been devised for rapidly and accurately packing flat-sided articles of uniform thickness, width and length in prescribed numbers into boxes, or alternatively, such articles may be arranged in stacked groups and then carried in such groups for subsequent packaging. The machine utilizes a series of vane-like members which are driven in a continuous curvilinear path to cause each member to present its loading surface immediately adjacent to a means for depositing the article to be packaged thereupon. Means are provided for containing the article upon the vane-like member and for stripping the article therefrom to effect its deposition into a packing box or between vertical members attached to a conveyor belt for subsequent packaging or handling.

DESCRIPTION OF A PREFERRED EMBODIMENT

Figure 1:
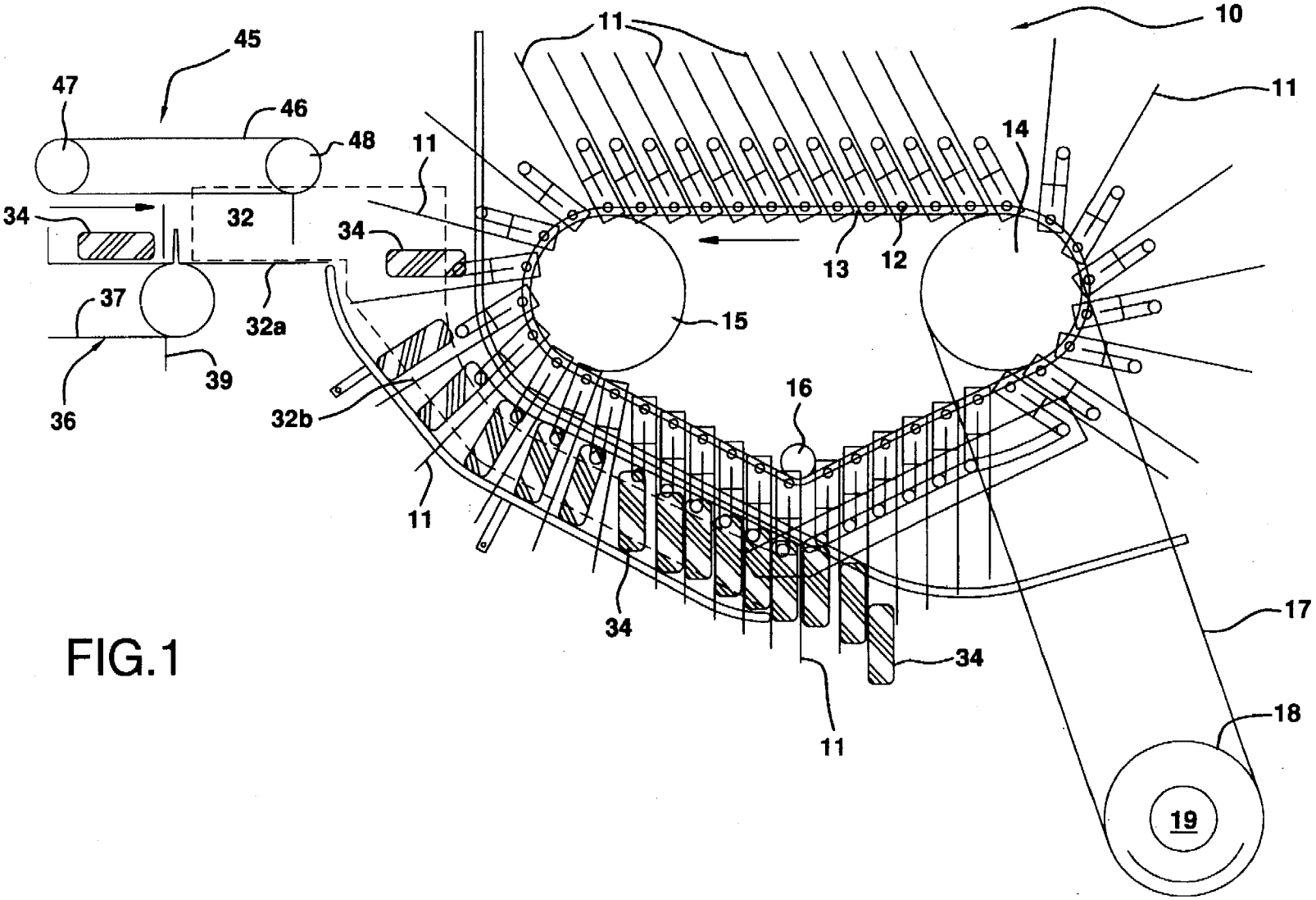
FIG. 1 is a side elevation of a machine which illustrates the handling and packaging of donuts in accordance with the present invention.

Referring now to the drawing and initially to FIG. 1 thereof a machine 10 for carrying out the objective of the invention has been illustrated. The machine 10 includes a plurality of vanes 11 (the construction of which shall be described more specifically in connection with FIG. 3) vanes 11 being mounted separately upon individual shafts 12 to permit selective rotation with respect to adjacent vanes 11. The respective shafts 12 are attached to a chain 13 which passes about sprockets 14–16. Sprocket 14 is driven by a chain 17 which passes around drive sprocket 18 connected to an electric motor 19 to effect movement of the entire array of vanes 11 in a curvi-linear path as illustrated in FIG. 1 in the direction shown in FIG. 1.

Figure 3:
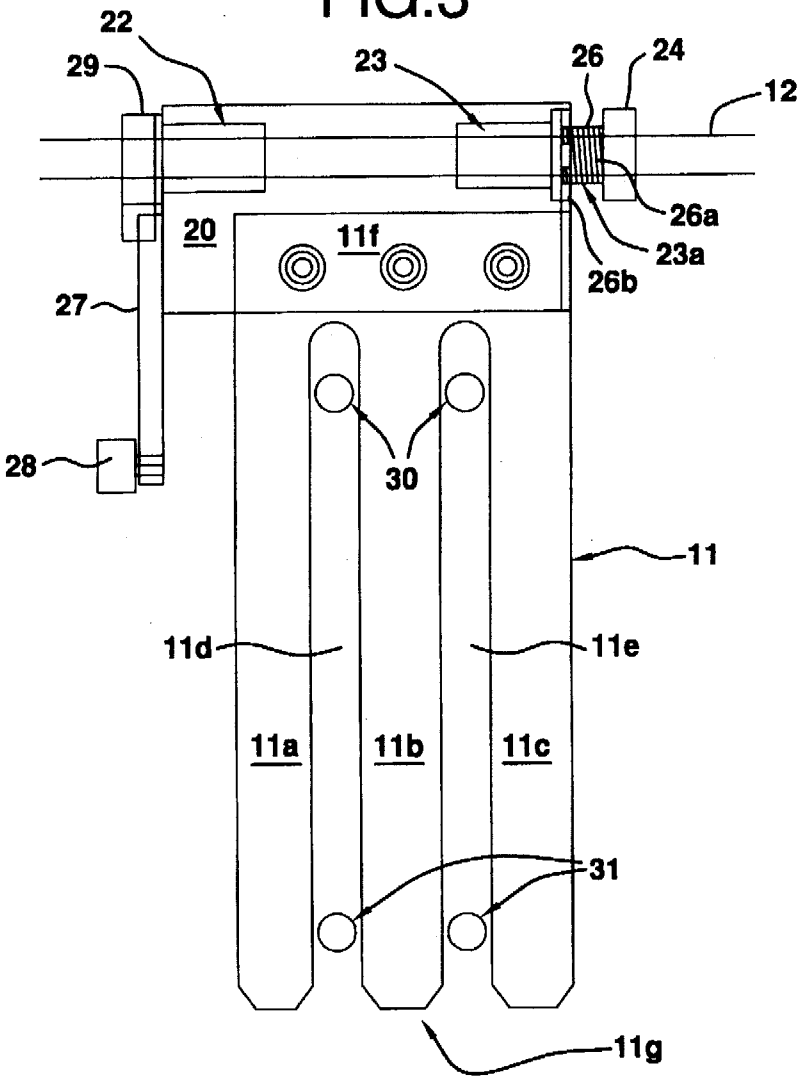
FIG. 3 illustrates in detail the design of the major donut loading and transferring member.

FIG. 3 illustrates the construction of each individual vane 11 and adjacent assembled and cooperating parts. Intermediate each vane 11 and a shaft 12 about which limited rotation of the vane has been provided, is a mounting block 20 to which the proximate end **11*f* of vane 11 has been attached by screws 21. The block 20 has bushings 22, 23 which receive shaft 12 for permitting rotation of block 20 about shaft 12. Bushing 23 extends laterally for a distance as section 23*a* from within block 20. Adjacent thereto is a flange 24 which is fixed to shaft 12. A torsion spring 26 is attached at one end 26*a* to flange 24 and extends over section 23*a* to be connected at its opposite end 26*b* to the flanged end 23*b* of bushing 23. The purpose of torsion spring 26 is to bias each vane 11 in the respective positions illustrated across the top of FIG. 1 and subsequently to permit limited individual rotation of each vane 11 about its shaft 12, as shall be described, during movement of the array of vanes 11 about the path illustrated in FIG. 1. As will be further seen in FIG. 3, attached to each block 20 is an arm 27 which carries at one end thereof a cam roller 28. Each cam arm 27 is rotatably connected to shaft 12 by a bushing 29 so that block 20, vane 11 and cam arm 27 shall rotate together about shaft 12 alternately under the control of torsion spring 26 or of cam arm 27 and roller 28** as shall be described.

Each vane 11 has three fingers **11*a*, 11*b*, 11*c* extending to the outward or distal end 11*g* of the vane's proximate connection to mounting block 20. Fingers 11*a*–11*c* define therebetween elongated slots 11*d* and 11*e* which are adapted to receive pairs of inner retainer/stripper rods 30 and outer retainer rods 31**.

Referring to FIG. 1, it will be seen that the machine 10 has been adapted to load a series of members 34 which have been received seriatim from a conveyor 36. Members 34 may be any essentially flat rectangular or round objects a plurality of which shall be packaged closely adjacent to each other while resting upon the respective edges thereof with the sides in close proximity. In the present illustration, the members are donuts (which shall ideally be contained in placticine envelopes) but it will be understood that individual envelopes of foodstuffs, for example, dried soup or gravy mixes, and the like can readily be packaged (boxed) by applying the concept and mechanisms of this invention.

Figure 2:
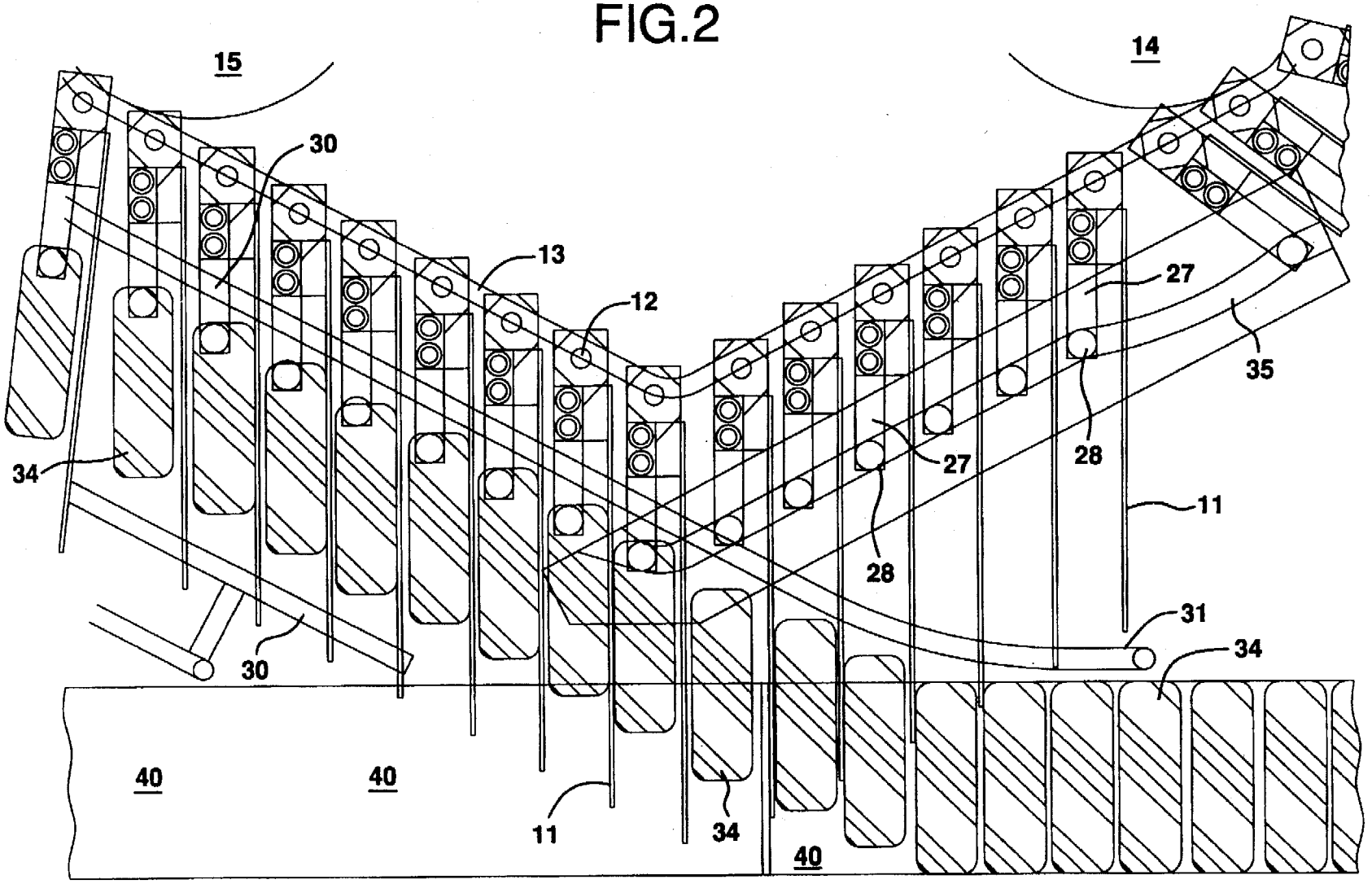
FIG. 2 is an enlarged view of a section of the machine of FIG. 1 showing the disposition of a series of donuts into boxes.

Accordingly, as illustrated in FIG. 1, the array of vane/cam roller assemblies mounted upon their individual shafts 12 and attached to chain 13 are driven in the direction of the arrow (across the top of the Figure) toward conveyor 36. The latter includes a continuous belt 37 and a drive means (not shown) the belt passing around a pulley 38 arranged immediately adjacent to the path of the upper flight of vane/cam roller assemblies. As each vane assembly begins its approach toward conveyor 36 two things occur: a) the two parallel inner retainer and stripper rods 30 shall enter slots **11*e* and 11*d* in each vane 11 and b) the space between adjacent vanes 11 shall open (become angularly greater) as a result of the curvature of its prescribed path as illustrated and to present each vane horizontally as it becomes immediately adjacent to conveyor 36. Between conveyor 36 and the respective paths of vanes 11 is a retainer 32 constructed to receive each donut 34 upon a horizontal surface 32*a* thereof. Vertical separators 39 are attached to conveyor 37. Located immediately above conveyor 36 is a mechanism 45 comprising a belt 46 which passes around rollers 47, 48 one of which shall be driven by motor means (not shown). Depending vertically from belt 46 are shuttles 49 which shall force each donut 34 from the belt 37 onto and across the surface 32*a* to then be received by the loading surface 11*h* of a vane 11. The retainer 32 thus bridges the gap between the conveyor 36 and respective vanes 11 as they are loaded. Retainer 32 has been constructed to have sides 32*b* which extend downwardly along each side of vanes 11 as they each proceed from their horizontal loading positions to their vertical unloading positions. The retainer 32 thus laterally contains each donut 34 upon its respective vane's loading surface. During the aforesaid travel of vanes 11 inner retaining rods 31 shall enter openings 11*d* and 11*e* between vane fingers 11*a*–11*c* to abut the lower ends of donuts 34 until each shall be released into a packing box. Referring to FIG. 2, beneath the counterclockwise moving array of vane/cam roller assemblies a moving continuous lengthwise series of open-topped boxes 40 having end partitions 40***a* have been arranged in tandem each of which is sized to receive and to contain in closely packed relationship a specific member of donuts.

Intermediate adjacent end partitions 40*a* are vertical separating and carrying means 50 which are attached at their lower ends to a conveyor belt 51 which moves at a predetermined speed (in the direction indicated by the arrow) which is synchronized with the horizontal speed of the array of vanes 11 and donuts 34.

As illustrated, sequential discharge of donuts from between adjacent ones of the vanes 11 shall occur after such vanes have become vertical and are aligned with each box 40 to be packed. During the unloading and packing sequence each box 40 and respective paired adjacent vanes shall move such that the horizontal travel of boxes 40 shall be sufficiently greater than the relative horizontal travel of each paired adjacent vane to accomplish close stacking of donuts one after the other until each box has been filled. During such loading, each donut shall be closely contained between adjacent pairs of vanes 11, retainer 32, inner retainer/stripper rods 30 and outer retaining rods 31. Furthermore rods 30, 31 are oriented so that each donut is moved toward and into its respective box until each is filled. In order to accomplish this objective satisfactorily, cam track 35 has been positioned to receive cam rollers 28, each of which is attached to its respective arm 27 and thereby to a vane 11. Track 35 has been geometrically shaped to cause cam roller arm 27 to maintain each vane 11 in a depending vertical position (against the resistance of torsion spring 26) as the array of vane/cam roller assemblies begins to move upwardly and away from boxes 40. During such movement outer retainer rods 31 shall no longer block discharge of each donut into its respective box and inner stripper/retainer rods shall force each donut downwardly into a box 40. Once such discharge has been completed, each cam roller 28 shall emerge from track 35 and each vane/cam roller assembly shah be returned by its spring 26 to the orientation shown in FIGS. 1 and 2 to repeat the process and operation just described.

It should be mentioned that while in the illustrated embodiment, donuts 34 are loaded directly into boxes 40 arranged and carried by belt 51 between the respective vertical members 50 attached thereto, it is also contemplated that donuts 34 (or other uniformly sized articles) may be packed between vertical members 50 without the use of boxes. In this application of the invention, such articles shall be carried in uniformly arranged groups to a subsequent station for handling.

It will be understood that the foregoing description has been of a particular embodiment of the invention and has therefore been merely representative. In order to appreciate fully the scope of the invention, reference should be made to the appended claims.

We claim:

1. A machine for rapidly packaging articles having generally parallel flat sides and of generally uniform length, width and thickness comprising:

a) a plurality of vane-like members, means interconnecting each said vane-like member and means for moving said plurality of vane-like members in an endless curvi-linear path to move successive ones of said members through a loading station and through an unloading and packing station;

b) each vane-like member defining a flat loading surface thereupon and means for loading an article thereupon during passage of each member through said loading station;

c) means for securing each said article upon said loading surface and for moving each said vane-like members and articles toward and through said unloading and packing station;

d) means for releasing each said article sequentially from said vane-like members as successive said members pass through said unloading and packing station;

e) said securing means also including means to effect movement of each said article from between adjacent vane-like members to discharge said article therefrom during movement of successive vane-like members through said unloading and packing station;

f) prior to loading each individual article upon the loading surface of a vane-like member, the means for loading includes means for rotating each said vane-like member relative to the next succeeding member to increase the relative distance between said members at their respective distal ends in order to facilitate the placement of an article upon said member;

g) each vane-like member defining parallel elongated slots extending from the distal end thereof generally adjacent to the proximate end thereof for a distance greater than the length of an article, said slots being spaced apart less than the width of an article, the means for loading each said article causing said article to lie upon said member to have said slots underlie said article widthwise and to extend beyond said article lengthwise; and h) means for securing each said article including two parallel pairs of stationary elongated members mounted and located to pass through said slots, one pair thereof being located relatively closer to the proximate end of each said vane-like member and the other being located relatively closer to the distal end of said member.

2. The machine according to claim 1 which includes means for rotating each said vane-like member about said respective shaft means after an article has been loaded thereupon to decrease the relative distance between said members at their respective distal ends and to cause each said article to be held by and between adjacent ones of said vane-like members.

3. The machine according to claim 2 which further includes barrier means extending immediately adjacent to the ends of said vane-like member to restrain lengthwise moement of said article.

4. The machine according to claim 3 wherein said vane-like members are moved in tandem from an article loading position to an article discharging position at said unloading station, a conveyor belt at said unloading station, a plurality of spaced apart members attached to said belt extending toward said vane-like members, said members defining an opening therebetween to receive successive ones of said articles at a speed greater than the movement relative thereto of said vane-like members such that said inner and outer pairs of elongated members together act to contain, move and stack each article successively into the space between respective pairs of said vertical members, to be carried together in groups by said belt.

5. The machine according to claim 4 wherein interposed and closely fitted between respective pairs of said vertical members are individual packing boxes resting upon said belt into which said articles are closely stacked adjacent to each other.

6. The machine according to claim 5 wherein the loading means includes a conveying means for depositing said articles upon the loading surface of each vane-like member when said loading surface is in a generally horizontal position, each said vane-like member being thereafter moved through said curvi-linear path to cause each said vane-like member to assume a vertical position with the distal end of each member being immediately above and in sequence with a predetermined section of an opening in a packing box adapted to receive successive ones of said articles, and means to maintain said vane-like members adjacent thereto in said vertical position until each article is entirely deposited and stacked in a packing box; and means subsequent to completion of each article having been stacked in a packing box to release each said vane-like member to assume an alternate non-vertical position.

7. The machine of claim 6 wherein the means for maintaining and releasing each said vane-like member in said vertical position is a cam track and cam means connected to each said vane-like member and the means to cause said member to assume an alternate position thereafter is spring biasing means connected intermediate each said member and its associated shaft.

8. A machine for rapidly packaging articles having generally parallel flat sides and having generally uniform length, width and thickness comprising:

a) a plurality of vane-like members, means interconnecting each said vane-like member and means for moving said plurality of vane-like members in an endless curvi-linear path to move successive ones of said members through a loading station and through an unloading station;

b) each vane-like member defining a flat loading surface thereupon and means for loading an article thereupon during passage of each member through said loading station;

c) each said article after being placed upon a loading surface being generally restrained top and bottom between adjacent ones of said vane-like members;

d) means for moving said vane-like members and articles from said loading station toward and through said unloading station;

e) means for securing each said article from sliding from between adjacent restraining vane-like members during curvi-linear movement thereof from said loading station to said unloading station; said securing means further effecting positive ejecting movement of each article to discharge each article from between adjacent vane-like members while passing through said unloading station.

9. The machine according to claim 8 wherein said securing means comprises barrier means located adjacent to each end of said article when said article is located upon said loading surface, one of said barrier means being generally adjacent to the distal end of each said vane-like member and the other being located generally adjacent to the proximate end of each vane-like member to contain said article lengthwise upon said loading surface, and means for removing said barrier means adjacent to the distal end and for moving said barrier means adjacent the proximate end of said member toward the distal end thereof to discharge each article from between adjacent vane-like members while passing through said unloading station.

10. The machine according to claim 9 wherein the loading means includes a conveying means for depositing said articles upon the loading surface of each vane-like member when said loading surface is in a generally horizontal position, each said vane-like member being thereafter moved through said curvi-linear path to cause each vane-like member to assume a generally vertical position with the distal end of each member being immediately above a surface adapted to receive said article upon ejection thereof from between adjacent vane-like members.

* * * * *